US006625911B2

(12) United States Patent
Kim

(10) Patent No.: US 6,625,911 B2
(45) Date of Patent: Sep. 30, 2003

(54) MANUALLY ADJUSTABLE DISPLAY DEVICE

(76) Inventor: Yo-Wang Kim, 409-401, Sekyung Apt. 885-1, Whophyoung 3-dong, Chunchon 200-160, Kangwon-do (KR)

( * ) Notice: Subject to any disclaimer, the term of this patent is extended or adjusted under 35 U.S.C. 154(b) by 0 days.

(21) Appl. No.: 10/019,238

(22) PCT Filed: Apr. 10, 2001

(86) PCT No.: PCT/KR01/00593

§ 371 (c)(1),
(2), (4) Date: Dec. 28, 2001

(87) PCT Pub. No.: WO01/78044

PCT Pub. Date: Oct. 18, 2001

(65) Prior Publication Data

US 2003/0005609 A1 Jan. 9, 2003

(30) Foreign Application Priority Data

Dec. 30, 2000 (KR) ..... 2000/0087046
Apr. 10, 2000 (KR) ..... 2000/0018730

(51) Int. Cl.[7] ..... G09F 9/37
(52) U.S. Cl. ..... 40/450; 40/492
(58) Field of Search ..... 40/450, 447, 492

(56) References Cited

U.S. PATENT DOCUMENTS

| | | | |
|---|---|---|---|
| 4,164,824 A | 8/1979 | Nidelkoff | |
| 4,220,948 A | 9/1980 | Trame | |
| 5,315,775 A | 5/1994 | Parker | |
| 5,526,559 A | 6/1996 | Roussel | |
| 5,566,482 A | 10/1996 | Smith | |
| 5,577,336 A | 11/1996 | Jensen | |

FOREIGN PATENT DOCUMENTS

| | | | |
|---|---|---|---|
| EP | 0 758 122 A1 * | 2/1997 | ..... G09F/9/37 |
| GB | 2 198 275 A * | 6/1988 | ..... G09F/9/37 |

OTHER PUBLICATIONS

US 5,388,355, 2/1995, Kalivas (withdrawn)

* cited by examiner

*Primary Examiner*—Cassandra H. Davis
(74) *Attorney, Agent, or Firm*—Birch, Stewart, Kolasch & Birch, LLP

(57) ABSTRACT

A manually adjustable display device for displaying information. The display device includes a frame containing a plurality of designated grooves; a plurality of side segments each including a display side and a non-display side disposed on an opposite side of the display side; a center segment including a display side and a non-display side disposed on an opposite side of the display side of the center segment; and a plurality of suspension members for suspending the side segments and the center segments in the designated grooves so that the side segments and the center segments can rotated within the designated grooves to display either the display or the non-display side of the segments. In another embodiment, the display device including a frame including an upper surface, a bottom surface separated from the upper surface by a predetermined depth, and a plurality of openings through the upper surface; a plurality of side segments each disposed on the bottom surface of the frame and visible through the plurality of openings, each side segment being slidable under the upper surface of the frame to be invisible; and a center segment disposed on the bottom surface of the frame and visible through one of the openings, the center segment being slidable under the upper surface of the frame to be invisible.

15 Claims, 17 Drawing Sheets

(perspective views of different examples)

▸ price indicator ▸ price indicator for supermarket materials of educational aids current interest rate board

MANUALLY ADJUSTABLE DISPLAY DEVICE

This application is the national phase under 35 U.S.C. §371 of PCT International Application No. PCT/KR01/00593 which has an International filing date of Apr. 10, 2001, which designated the United States of America and was published in English.

BACKGROUND OF THE INVENTION

1. Field of the Invention

The present invention relates to alphanumeric display devices and more particularly, to an improved, manually adjustable display device for displaying information and easily changing the content of the display manually.

2. Description of Related Art

Manually adjustable display devices are known in the art for displaying alphanumeric information such as gas prices at gas stations, scores for sports games, sales advertisements, etc. In the example of displaying gas prices at gas stations or the like, the display device typically includes a board and a plurality of display members in the shape of letters and numbers. To display a particular gas price, a gas station employee selects appropriate display members corresponding to the gas type and price (e.g., UNLEADED $1.19^{99}$) and attaches the selected display members on the board, e.g., using hooks or other fasteners. However, when the displayed gas prices need to be changed, the old display members corresponding to the old gas prices must be removed physically from the board and the new display members corresponding to the new gas prices must be attached to the board. This process must be repeated each time the gas price changes. As a result, the conventional manually adjustable display devices are extremely inconvenient to use. Further, with the conventional manually adjustable display devices, the display members corresponding to all the letters in the alphabet (e.g., 26 letters) and numbers (e.g., 0–9) must be kept at a safe place so that they can be re-used when the content being displayed by the display device needs to be changed. If any of the display members is misplaced or unavailable, the entire display device may become useless or it may be difficult to change the content being displayed by the display device. Thus, the conventional manually adjustable display devices require high-level maintenance and are inconvenient to use.

On the other hand, conventional electronic display devices are useless during power failures or suspension of power supply and can be expensive due to electrical charges.

SUMMARY OF THE INVENTION

Accordingly, an object of the present invention is to provide a manually adjustable display device which eliminates the above described problems and other problems encountered in conventional manually adjustable display devices.

Another object of the present invention is to provide an alphanumeric display device for easily changing the content being displayed by the display device in a cost effective manner.

Another object of the present invention is to provide a display device that can be manually adjusted without addition or removal of any alphanumeric components as in the prior art display devices.

A further object of the present invention is to provide a manually adjustable display device that is simple in structure, inexpensive to manufacture, durable in use, and refined in appearance.

Briefly described, the present invention is directed to a manually adjustable display device for selectively displaying information, the device comprising a frame containing a plurality of designated grooves; a plurality of side segments each including a display side and a non-display side disposed on an opposite side of the display side; a center segment including a display side and a non-display side disposed on an opposite side of the display side of the center segment; and a plurality of suspension members for suspending the side segments and the center segments in the designated grooves so that the side segments and the center segments can rotated within the designated grooves to display either the display side or the non-display side of the segments.

The present invention is further directed to a manually adjustable display device for selectively displaying information, the display device comprising a frame including an upper surface, a bottom surface separated from the upper surface by a predetermined depth, and a plurality of openings through the upper surface; a plurality of side segments each disposed on the bottom surface of the frame and visible through the plurality of openings, each side segment being slidable under the upper surface of the frame to be invisible; and a center segment disposed on the bottom surface of the frame and visible through one of the openings, the center segment being slidable under the upper surface of the frame to be invisible.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
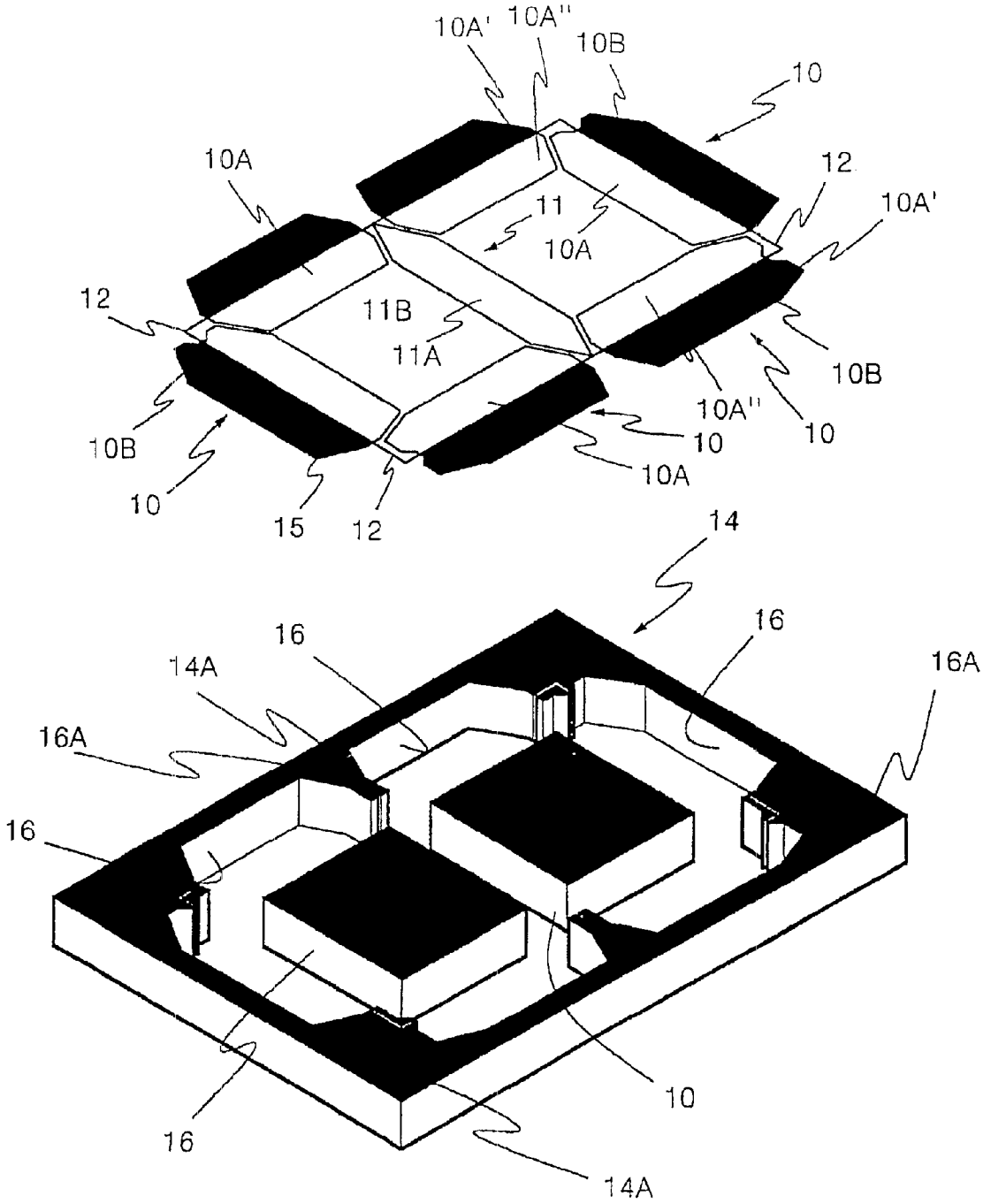
FIG. 1 is an exploded perspective view of a manually adjustable display device according to a first embodiment of the present invention.

Referring now in detail to the drawings for the purpose of illustrating the preferred embodiments of the present invention, FIG. 1 shows a perspective view of a manually adjustable display device according to a first embodiment of the present invention. As shown in FIG. 1, the manually adjustable display device includes six side segments 10, a center segment 11, a frame 14 containing a plurality of grooves 16 in the shape of a number eight "8" so that the side and center segments 10 and 11 are inserted therein, and six pairs of shafts 12 each pair disposed at the ends of the segments 10 and 11 along a central axis 15 thereof so that a portion of the shaft 12 projects from each of the two ends of the segments 10 and 11. In another embodiment, instead of having six pairs of shafts 12 each pair corresponding to a segment, six shafts may be provided to correspond to a segment, wherein each shaft passes through the central axis 15 of the segment with the ends of the shaft projecting out from the ends of the segment. The outer surface of the frame 14 is coated with a particular background color, e.g., black or white.

Each of the side segments 10 includes a display side 10A, and a non-display side 10B disposed on the opposite side of the display side 10A. The center segment 11 includes a display side 11A, and a non-display side 11B disposed on the opposite side of the display side 11A. Each non-display side 10B and the non-display side 11B are coated with the background color, i.e., the color of the outer surface of the frame 14. Each display side 10A is divided into two equal regions 10A' and 10A" separated along the central axis 15. Each outer region 10A' is coated with the background color. Each inner region 10A" and the display side 11A of the center segment 11 are coated with a display color that is distinctly different from the background color. For example, if a black color is chosen as the background color for the display and a white color is chosen as the display color, then the outer surface of the frame 14, the outer regions 10A' and the non-display side 11B of the center segment 11 are all coated with the same background color, in this example, the black color. The inner regions 10A" of the side segments 10 and the display side 11A of the center segment 11 are all coated with the display color, in this example, the white color.

The grooves 16 have sufficient space for freely rotating the segments 10 and 11 therewithin. The grooves 16 are configured to hold the ends of the shafts 12 therein so that the segments 10 and 11 are suspended within the grooves 16 by the shafts 12. The grooves 16 may include a plurality of indents 16*a* so that the ends of the shafts 12 can be inserted into the indents 16*a*, thereby securing the segments 10 and 11 within the grooves 16. In another example, the shafts 12 may be biased using springs or the like such that the ends of the shafts 12 exert force against the walls of the grooves 16, thereby securing the segments 10 and 11 within the grooves 16. Any configuration, which allows the rotation of the segments 10 and 11 within the grooves 16 by fixing the shafts 12 within the grooves 16, can be used. In order to ensure that the rotation of the segments 10 and 11 occurs only when an operator manually rotates the segments, and not by other means such as by wind power, the shafts 12 should be tightly secured within the grooves 16. at the same time, the shafts 12 should be rotatable by a human force. In order to improve the display quality of the display device, it is preferred that the segments 10 and 11 are positioned as close as possible to the outer surface 14*a* of the frame 14 so that the surfaces of the segments 10 and 11 and the outer surface 14*a* of the frame 14 are coplanar or substantially coplanar.

An operation of the manually adjustable display device according to the first embodiment of the present invention as follows. The shafts 12 of the segments 10 and 11 are positioned within the grooves 16 appropriately so that the segments 10 and 11 form the number "8". If a particular number or letter needs to be displayed, then the operator rotates one or more of the segments 10 and 11 (e.g., by pressing an edge of the segment) so that the combined effect of the segments 10 and 11 is the display of the desired number or letter. For example, assume that the operator desires to display a number "3". The operator rotates the two side segments 10 positioned on the left side (segments $\mathbf{10}_L$, $\mathbf{10}_L$) so that the non-display sides 10B having the background color (e.g., black) face the operator. The center segment 11 is rotated so that the display side 11A coated with the display color (e.g., white) faces the operator. The remaining four side segments 10 are rotated so that the display sides 10A face the operator. Since the inner regions 10A" of these four side segments 10 will display the display color (e.g., white), these four inner regions 10A" and the display side 11A form the number "3" and the display device of the present invention thereby displays the number "3". In this manner, any number or letter may be displayed by manually adjusting the segments of the display device. It should be noted that any color may be used as the background color and/or the display color.

Figure 2A:
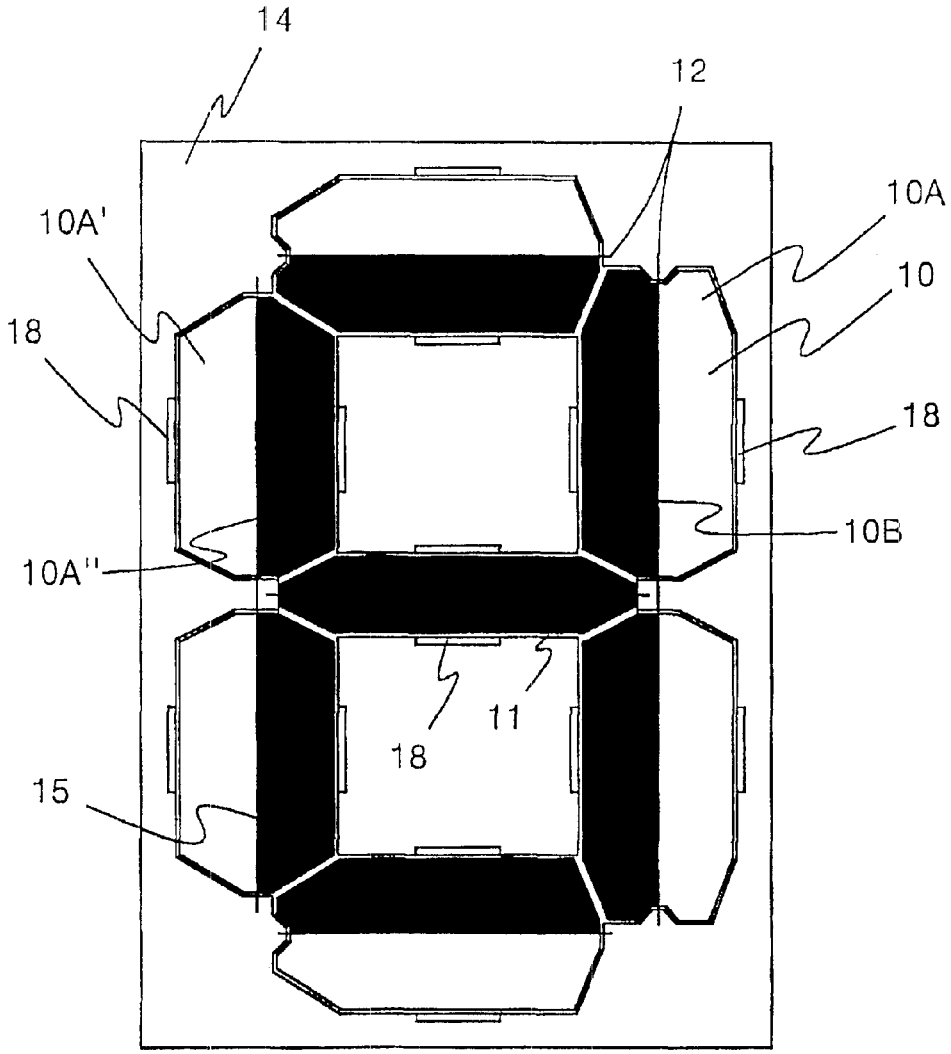
FIGS. 2(A) and 2(B) are front views of the manually adjustable display device according to a second embodiment of the present invention.
Figure 2B:
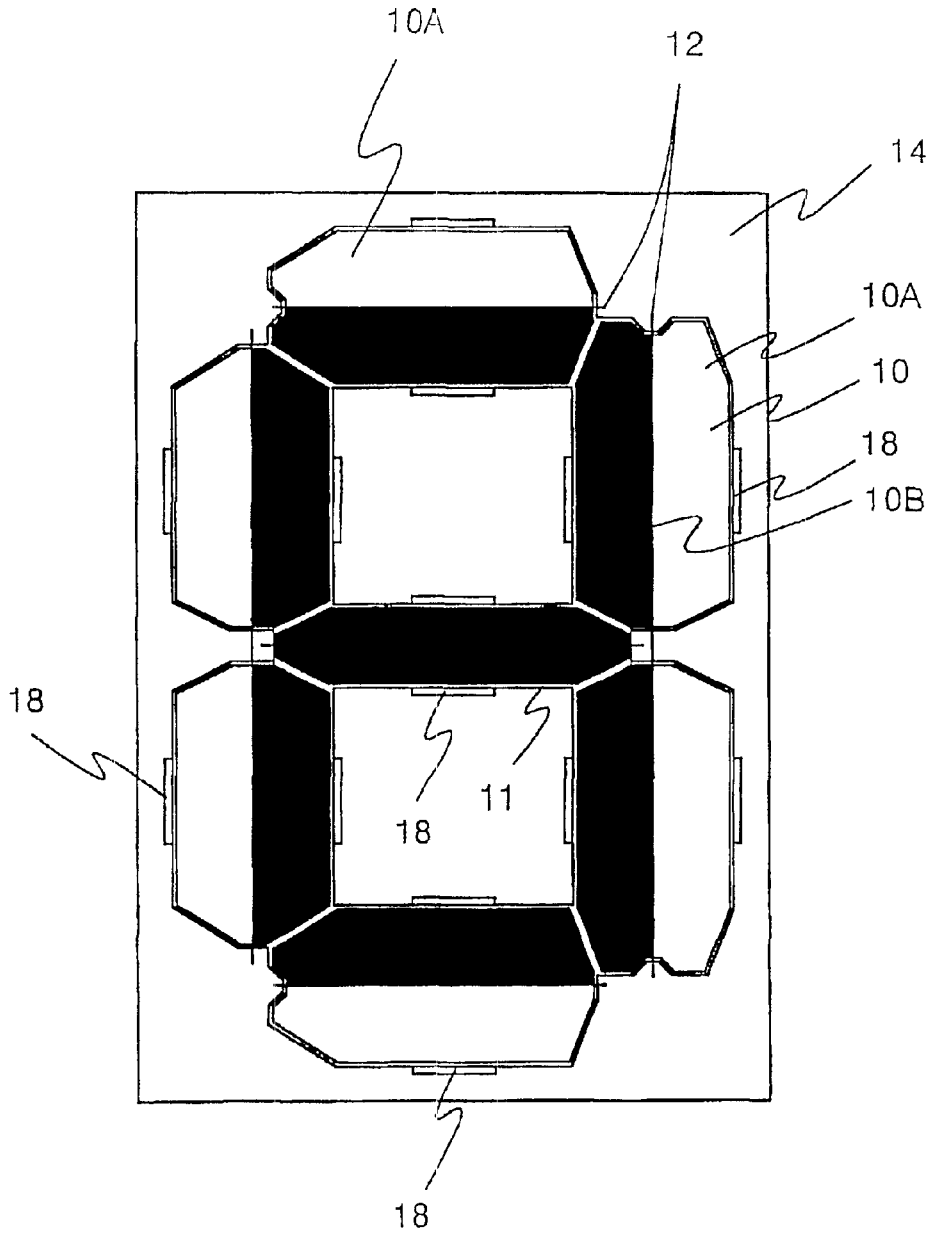

FIGS. 2(A) and 2(B) are front views of a manually adjustable display device according to a second embodiment of the present invention. The structure of the display device shown in FIGS. 2(A) and 2(B) is identical to the device of FIG. 1, except that the grooves 16 further include a plurality of groove extensions 18 for providing areas for insertion of the operator's fingers to facilitate the manual rotation of the segments 10 and 11. In the example shown in FIGS. 2(A) and 2(B), the white or light color has been selected as the background color, and the black or dark color has been selected as the display color. This means the outer regions 10A' and the non-display sides 10B and 11B are coated with the white or light color as shown in FIG. 2(B), whereas the inner regions 10A" and the display side 11A are coated with the black or dark color. If the operator wishes to display a number "3", two left side segments 10 are rotated within the grooves 16 so that their non-display sides 10B face the operator or the front, and the remaining side segments 10 are rotated within the grooves 16 so that their display sides 10A face the operator. The center segment 11 is rotated within the groove 16 so that its display side 11A faces the operator or the front. In this manner, the display device displays the "3" as shown in FIG. 2(B).

Figure 3A:
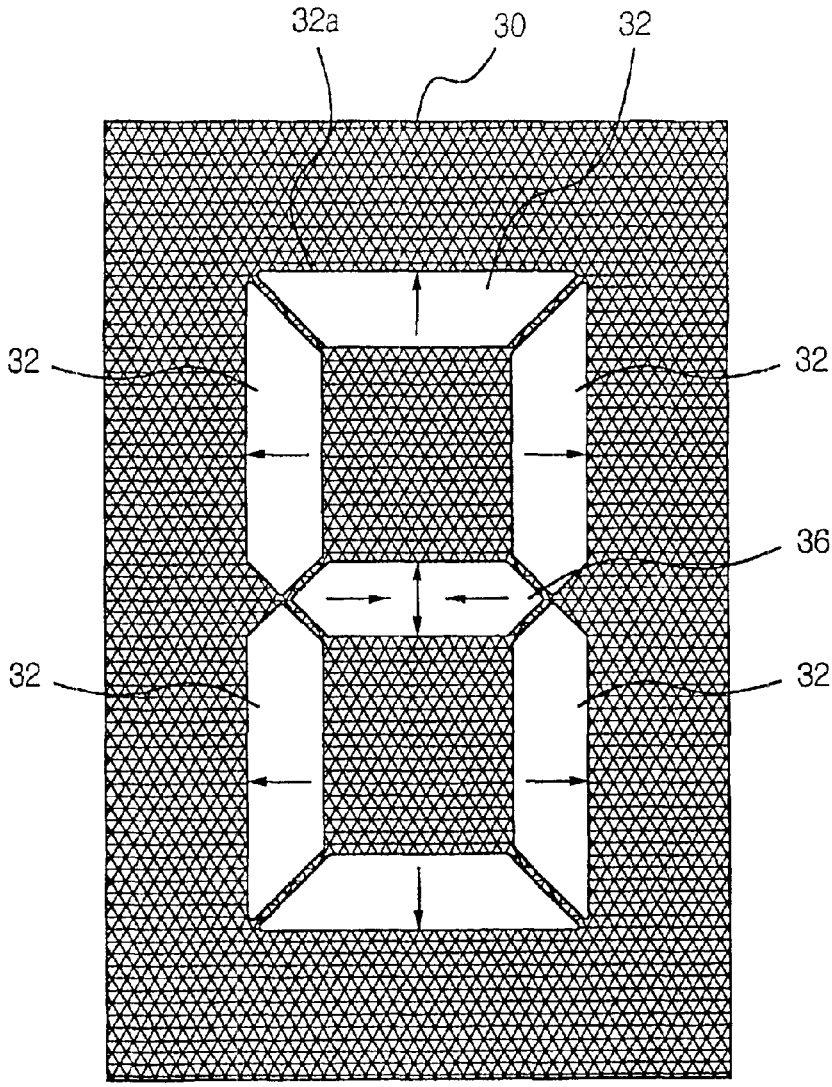
FIG. 3(A) is a front view of the manually adjustable display device in a display position according to a third embodiment of the present invention.

FIGS. 3(A)–8 illustrate a third embodiment of a manually adjustable display device according to the present invention. As shown in FIG. 3(A), the display device includes six side segments 32, a single center segment 38, and a frame 30 for supporting the segments 32 and 38 therein. The frame 30 is composed of an upper surface 30*b*, and a button surface 30*c* separated from the upper surface 30*b* by a certain depth D1 (FIG. 4), and further includes openings 30*a* defined through the upper surface 30*b*. The openings 30*a* are in the shape of a number "8" receive the side and center segments 32 and 38 therein.

Figure 4:
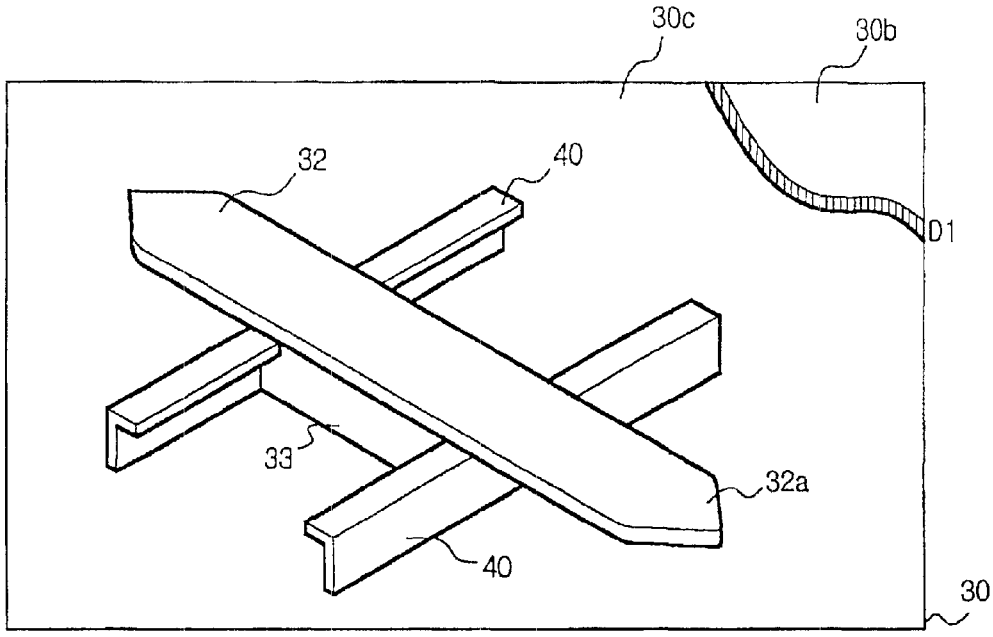
FIG. 4 is a partial perspective view of a side segment and its sliding mechanism used in the device of FIG. 3(A) according to the third embodiment of the present invention.

Each of the side segments 32 has a configuration as shown in FIG. 4, and includes a display portion 32*a* and a sliding portion 33 extending from the display portion 32*a*. The sliding portion 33 has a configuration so that it mates with a pair of guide rails 40, which allows the side segment 32 to slide along the rails 40 as the sliding portion 33 is moved along the rails 40. The pair of guide rails 40 is provided on the bottom surface 30*c* of the frame 30 for each of the side segments 32.

The upper surface 30*b* and the bottom surface 30*c* including the rails 40 are coated with the same background color, e.g., black. The display portion 32*a* of each side segment 32 is coated with a display color, e.g., white, so that the display color can be visibly recognized from the background color.

Figure 3B:
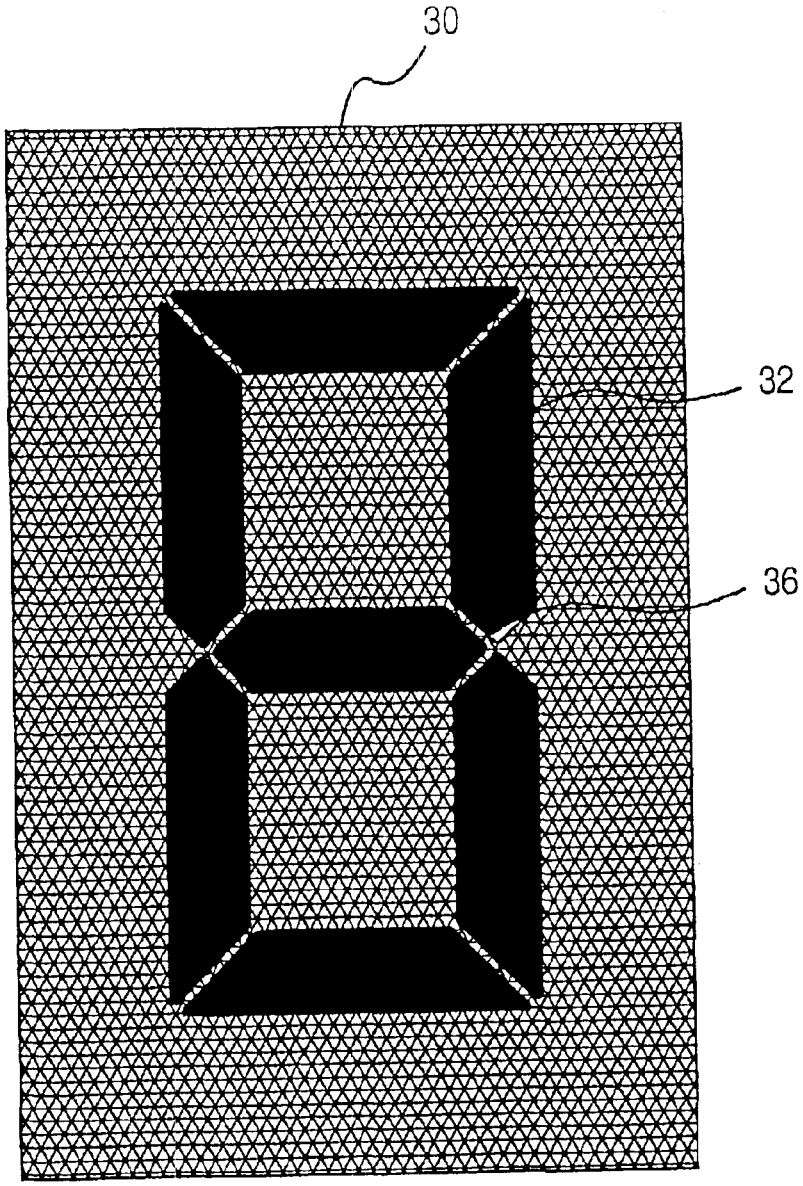
FIG. 3(B) is a front view of the manually adjustable display device of FIG. 3(A) in a non-display position according to the third embodiment of the present invention.

Each of the side segments 32 can move in the direction indicated by the arrows shown in FIG. 3(A) from a displayed position shown in FIG. 3(A) to a non-display position shown in FIG. 3(B). When the operator desires to move any one of the side segments 32 to display a particular number or letter, the operator slides the side segment 32 along its rails 40 in the indicated arrow direction so that the display portion 32*a* of the side segment 32 slides underneath the upper surface 30*b* of the frame 30 and is hidden from the view. As the display portion 32*a* of the side segment 32 disappear from the front view, the corresponding bottom surface 30*c* appears, which has been coated with the background color.

Figure 5A:
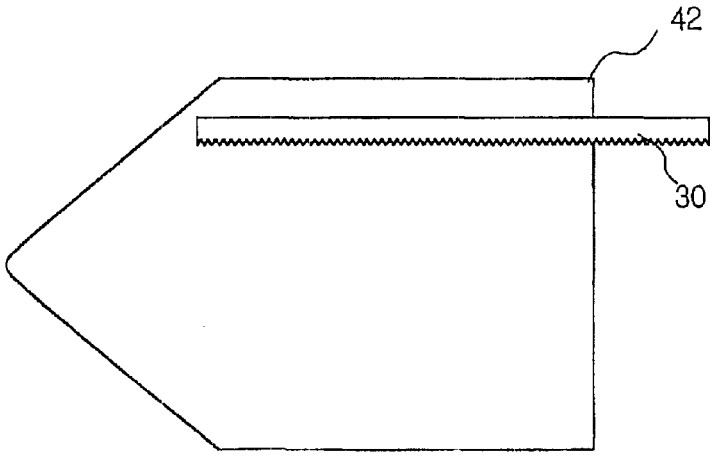
FIGS. 5(A), 5(B) and 5(C) are partial rear views of a center segment used in the device of FIG. 3(A) according to the third embodiment of the present invention.
Figure 5B:
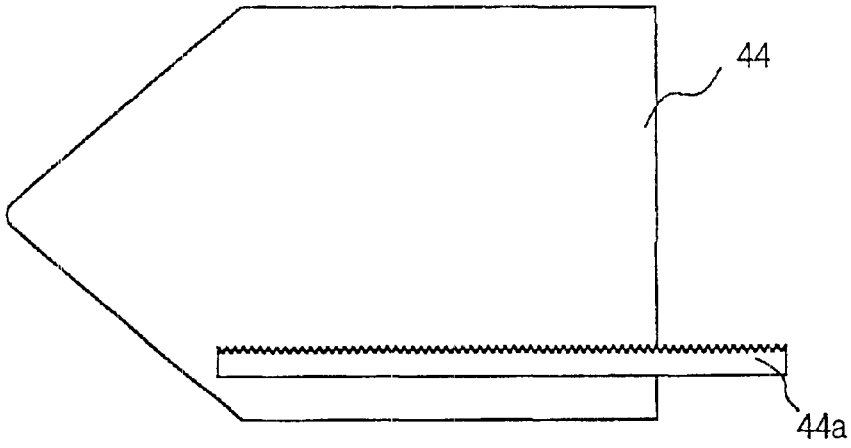
Figure 5C:
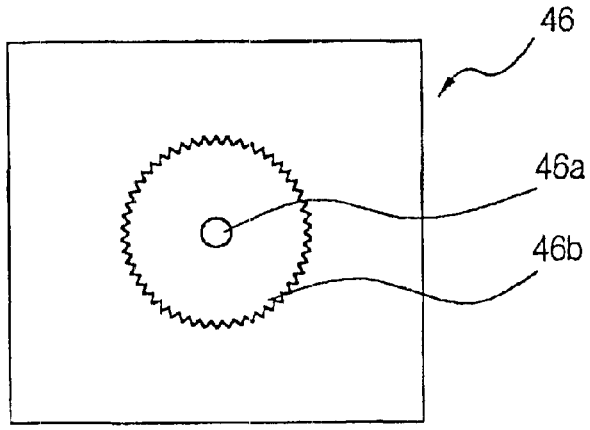

FIGS. 5(A) to 6(B) show perspective views of the center segment 38 and its mechanism for moving along the bottom surface 30*c* of the frame 30. As shown in FIGS. 5(A), 5(B) and 5(C), the center segment 38 is composed of a left panel 42, a right panel 44, and a center pinion panel 46. The left and right panels 42 and 44 of the center segment 38 include straight line rack gears 42*a* and 44*a* disposed on a rear side thereof, respectively. The center pinion panel 46 includes a pinion gear 46*b* and a coaxial member 46*a*. The pinion gear 46*b* is in gearing relationship with the pair of rack gears 42*a* and 44*a* as shown in FIG. 6(A). The rack gears 42*a* and 44*b* and the pinion gear 46*b* are old components that are well known in the art.

Figure 6A:
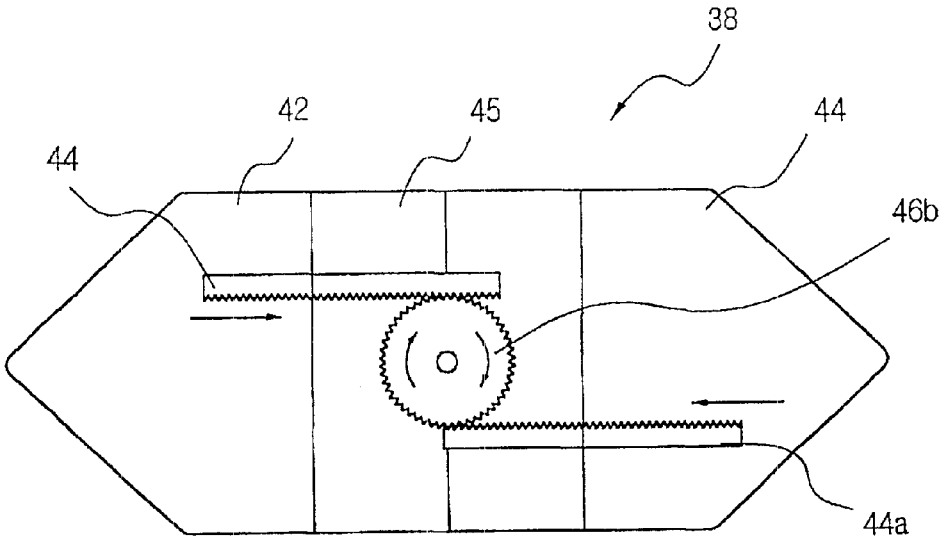
FIGS. 6(A) and 6(B) are rear views of the center segment and its sliding mechanism used in the device of FIG. 3(A) according to the third embodiment of the present invention.
Figure 6B:
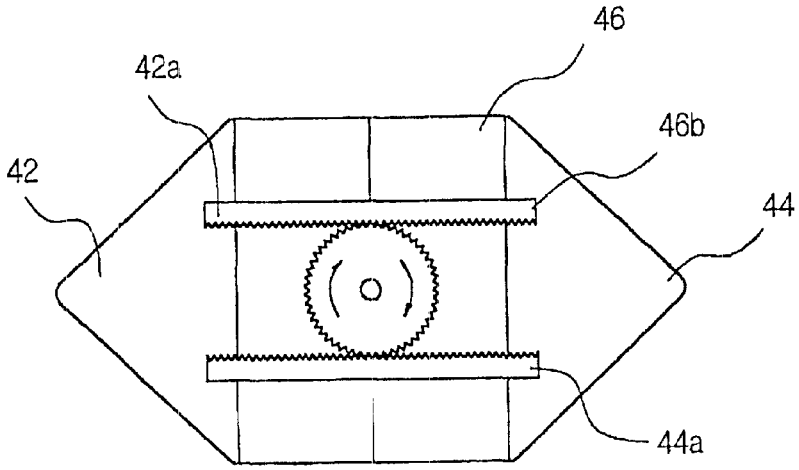
Figure 7:
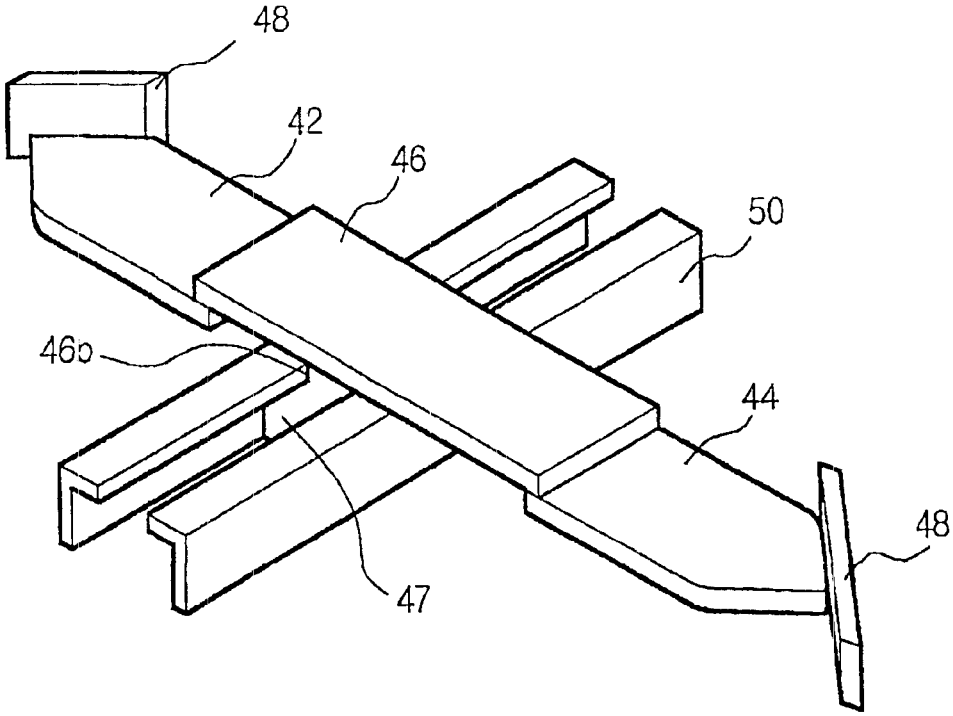
FIG. 7 is a partial perspective of the center segment used in the device of FIG. 3(A) according to the third embodiment of the present invention.

If the operator desires to move the center segment 38 on the frame 30 so that it disappears from the operator's view, the operator pushes in the ends of the left and right panels 42 and 44 inwardly as indicated by the arrows in FIGS. 6(A) and 7. This causes the left and right panels 42 and 44 to slide in under the center pinion panel 46 due to the gearing relationship of the rack gears 42*a*, 44*a* and the pinion gear 46 as shown in FIG. 6(B). Then the shortened center segment 38 can be moved either upwardly or downwardly by sliding a sliding portion 47 of the center pinion panel 46 along a pair of rails 50 provided on the button surface 30*c* of the frame 30 (FIG. 7). The rails 50 and the operation thereof are identical to the rails 40 and their operation. In this manner, the size of the center segment 38 can be reduced and the reduced center segment 38 can be moved to be disappear from the view.

In another embodiment, as shown in FIG. 7, a pair of guiding members 48 may be provided such that they can be used to reduce the center segment 38 into a shortened shape as shown in FIG. 6(B). The operator merely pushes the center segment 38 along the rails 50, which in turns causes the left and right panels 42 to slide in underneath the center panel 46 due to the guiding members 48.

Figure 8:
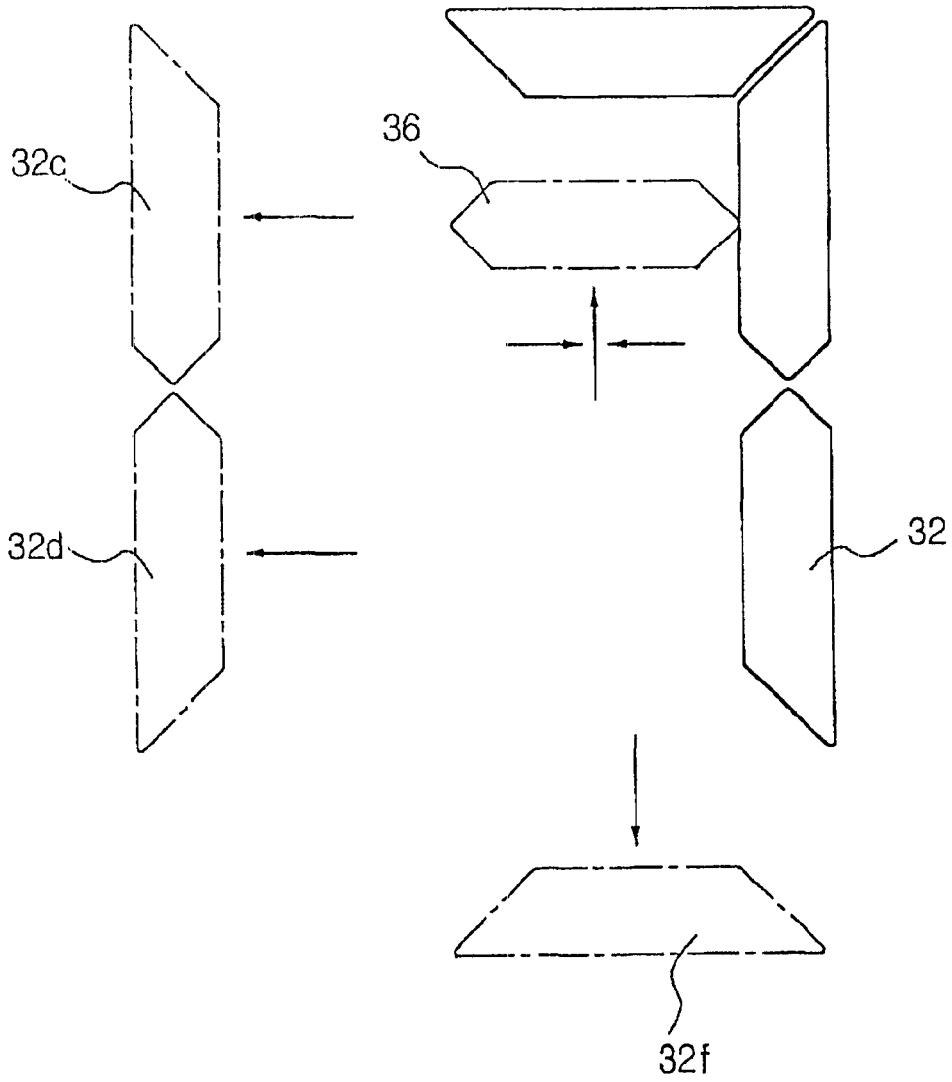
FIG. 8 is an example of the display device of FIG. 3(A) for explaining how the display device can be manually adjusted to display information.

FIG. 8 shows an example of the display device of FIG. 3(A) for explaining how the display device can be adjusted manually to display desired information. As shown in FIG. 8, assume that the operator desires to display a number "7". To accomplish this, two left side segment 32*c*, 32*d* and one lower side segment 32*f* are pushed out in the indicated arrow directions by the use of the rails 40 as discussed above in connection with FIG. 4. This causes these side segments 32 to slide in underneath the upper surface 30*b* of the frame 30 so that they are no longer visible. Then the center segment 38 is reduced into a shortened form as discussed above in connection with FIG. 6(B) and the shortened center segment 38 is pushed out upwardly (or downwardly if desired) so that it slides in underneath the upper surface 30*b* of the frame 30 and become invisible to the operator. Therefore, the remaining side segments 32 form the number "7" and the display device displays the number "7".

The manually adjustable display device according to the embodiments of the present invention offers numerous applications. The display device can include one or more grooves in the shape of "8" and the corresponding to segments, so that one or more different alphanumerals can be displayed. Furthermore, the size of the grooves as well as the background and display colors can differ to provide different sizes and colors of alphanumerals depending on the application. FIGS. 9–16 show different applications of the manually adjustable display devices of the present invention. Obviously, other examples are possible.

Figure 9:
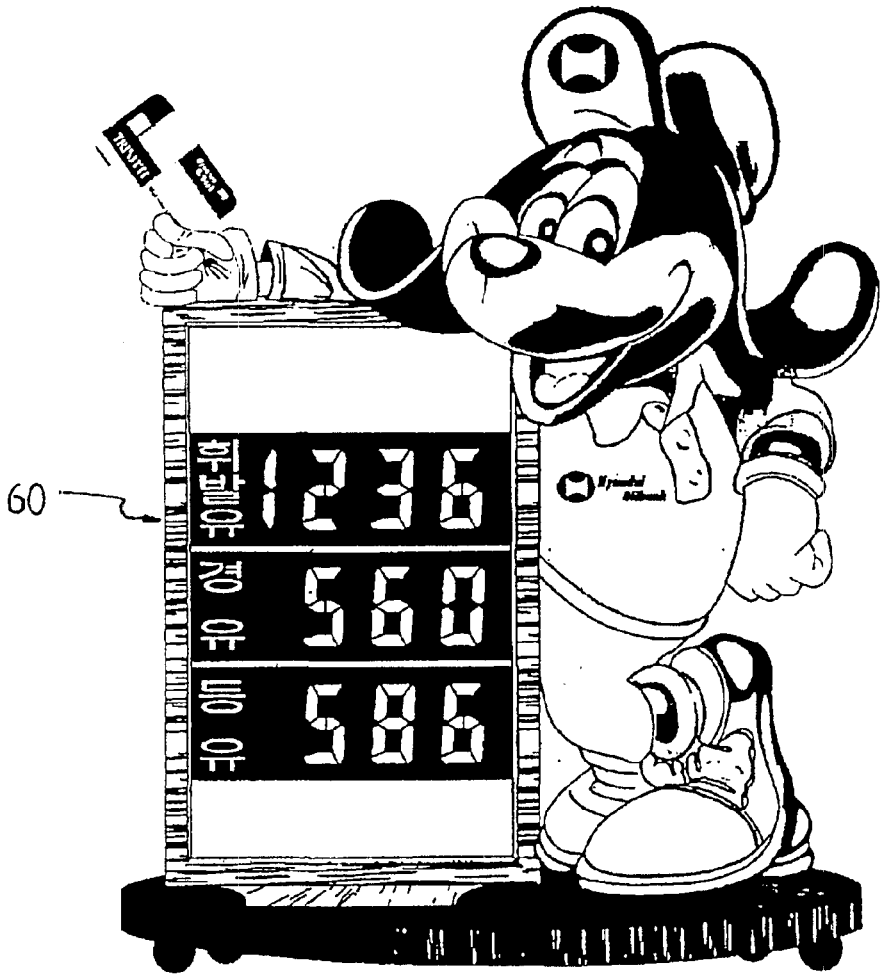
FIGS. 9–16 are perspective views of different examples of applications of the manually adjustable display device according to the embodiments of the present invention.
Figure 10:
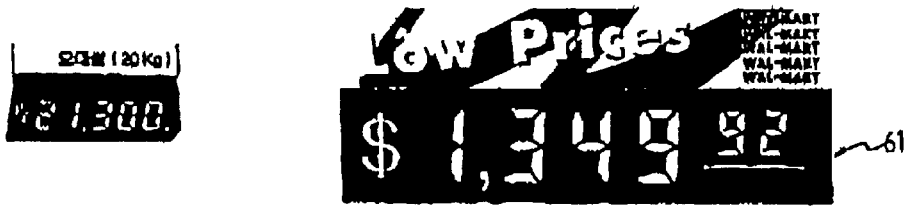
Figure 11:
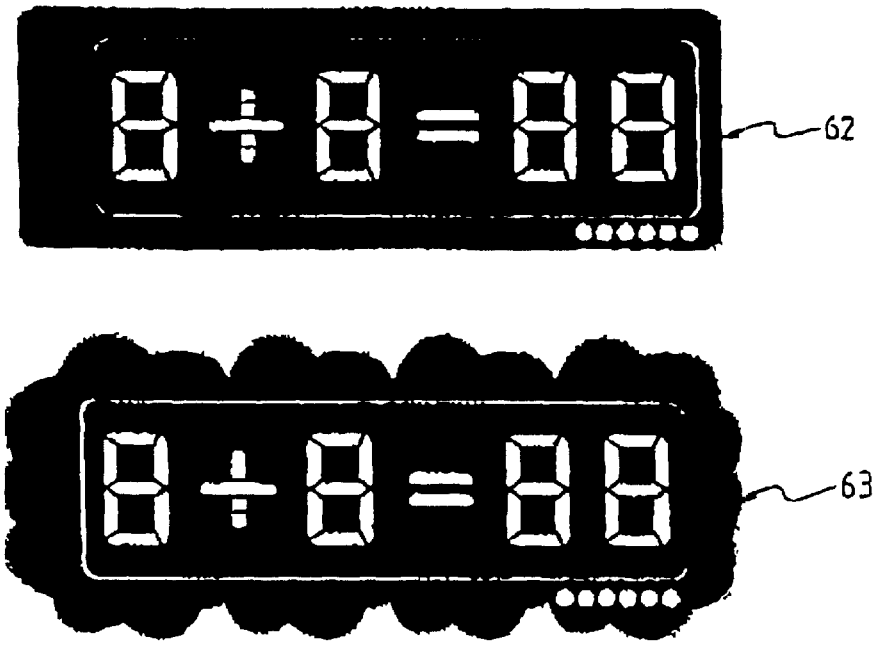
Figure 12:
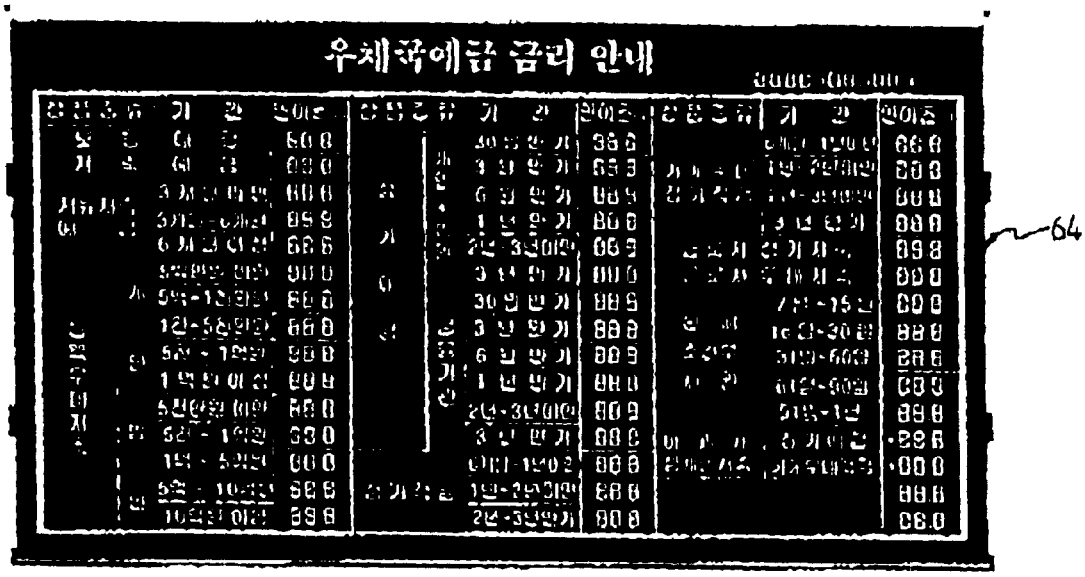
Figure 13:
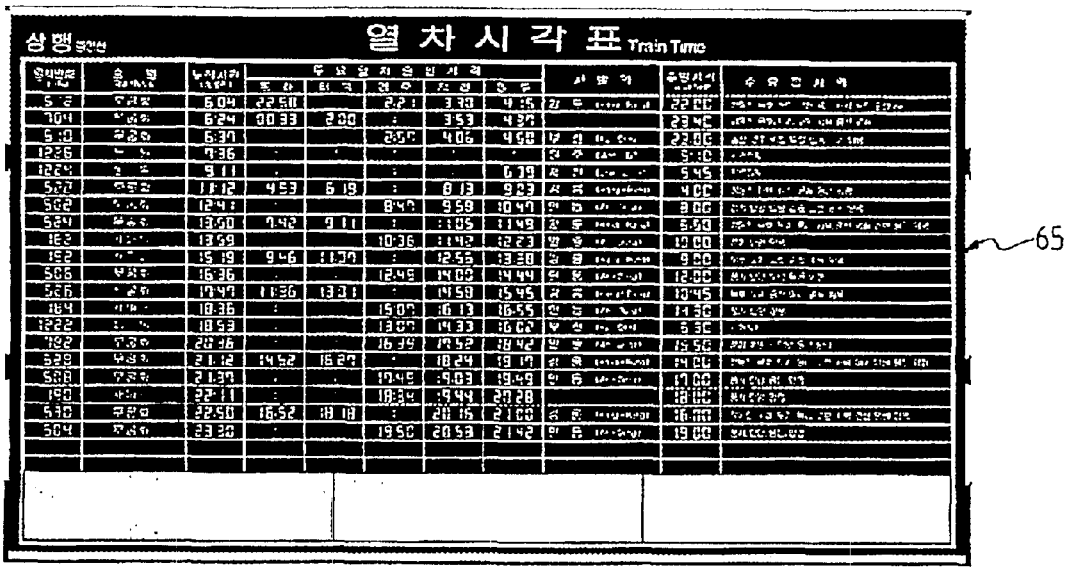

As shown in FIG. 9, the manually adjustable display device can be utilized as a gasoline price plate 60. This gasoline price plate can be attached to the walls or the pillars at gas stations. As shown in FIG. 10, the manually adjustable display device can be utilized as an item price plate 61 for displaying prices of different products at locations such as shopping centers, grocery stores, etc. Particularly, during the sales season, the use of the display device can reduce or eliminate labor expenses and other costs associated with using conventional manually adjustable display devices or conventional electronic display devices. As shown in FIG. 11, the manually adjustable display device can be utilized as a teaching tool 62 or a toy 63 for educating children about mathematics, vocabulary, etc. As shown in FIG. 12, the manually adjustable display device can be utilized as an interest rate or financial information display plate 64 which may be disposed on the walls of a financial institution such as a bank. As shown in FIG. 13, the manually adjustable display device can be utilized as a rail way timetable 65 which may be disposed on the walls of a train station, or as a drug price list plate for displaying the prices of different drugs at pharmacies.

Figure 14:
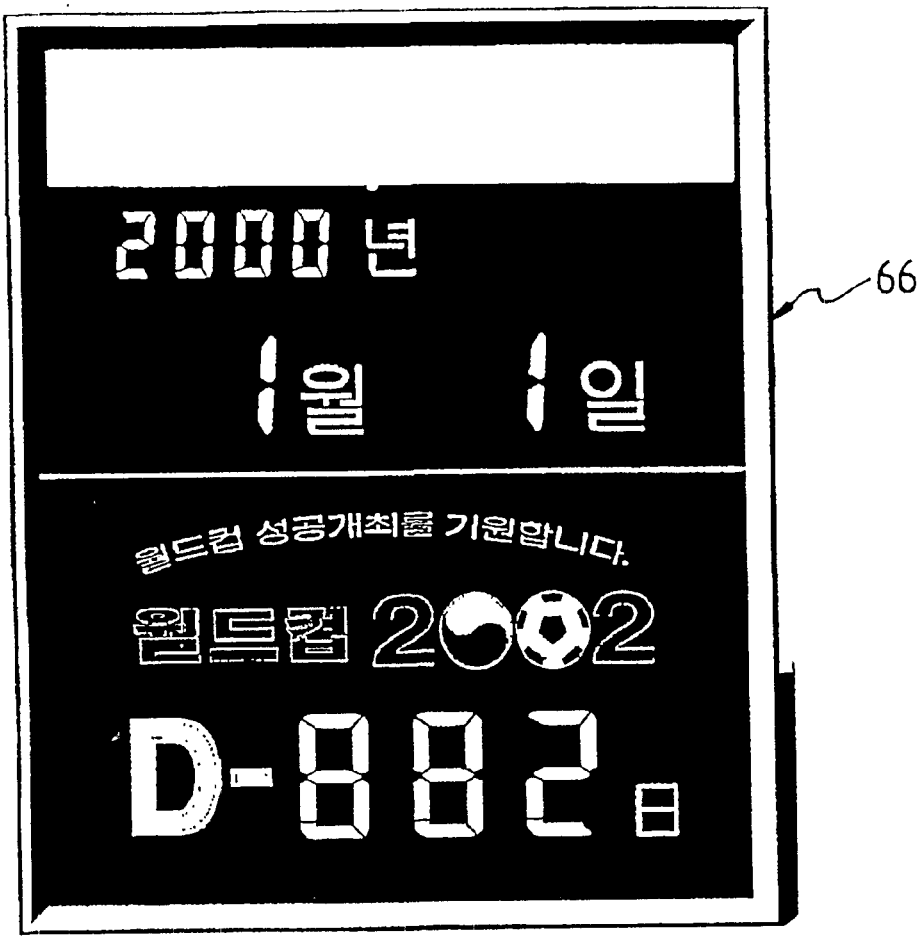
Figure 15:
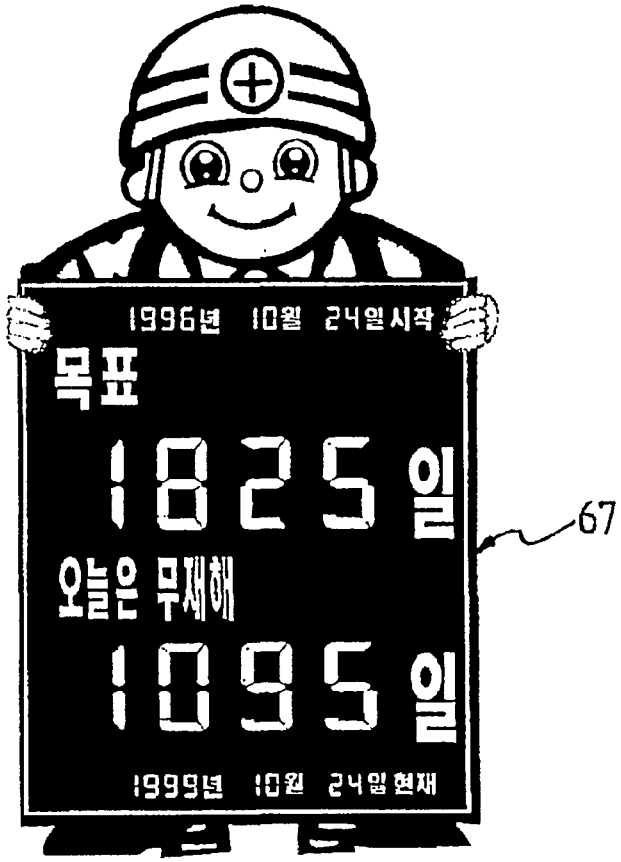
Figure 16:
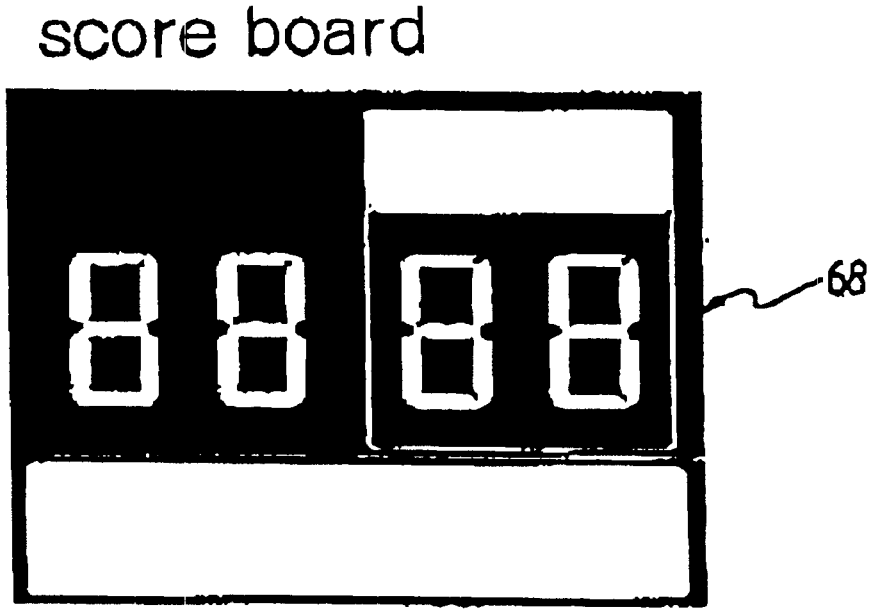

As shown in FIG. 14, the display device can be utilized as a count board 66 for counting days or other parameters. As shown in FIG. 15, the display device can be utilized as a goal count board 67 for identifying a projected goal to be achieved and the number of days or the like remaining until the projected goal can be achieved. As shown in FIG. 16, the display device can be utilized as a sports game scoreboard 68, so that the game scores can be displayed and updated with minimum expense and maximum convenience.

The invention being thus described it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A manually adjustable display device for selectively displaying information, the device comprising:

a frame containing a plurality of designated grooves;

a plurality of side segments each including a display side and a non-display side disposed on an opposite side of the display side;

a center segment including a display side and a non-display side disposed on an opposite side of the display side of the center segment; and a plurality of suspension members for suspending the side segments and the center segments in the designated grooves so that the side segments and the center segments can be rotated with the designated grooves to display either the display side or the non-display side of the segments, wherein the frame is coated with a first color, the non-display side of each side segment is coated with the first color, and the non-display side of the center segment is coated with the first color, the display side of each side segment being divided into outer and inner regions, each outer region being coated with the first color, each inner region being coated with a second color, and the display side of the center segment being coated with the second color.

2. The display device of claim 1, wherein the designated grooves are defined in the frame in the shape of a number eight.

3. The display device of claim 1, wherein there are six side segments.

4. The display device of claim 1, wherein each of the suspension members includes a pair of shafts projecting out of ends of one of the side and center segments.

5. The display device of claim 1, wherein the outer and inner regions are equally divided along a center line of each side segment.

6. The display device of claim 1, wherein the first color is a color darker than the second color.

7. The display device of claim 1, wherein the second color is a color darker than the first color.

8. The display device of claim 1, wherein the frame further includes a plurality of groove extensions for providing easy access to an edge of each side segment and the center segment.

9. A manually adjustable display device for selectively displaying information, the display device comprising:

a frame including an upper surface, a bottom surface separated from the upper surface by a predetermined depth, and a plurality of openings through the upper surface;

a plurality of side segments each disposed on the bottom surface of the frame and visible through the plurality of openings, each side segment being slidable under upper surface of the frame to be invisible; and a center segment disposed on the bottom surface of the frame and visible through one of the openings, the center segment being slidable under the upper surface of the frame to be invisible, wherein each of the side segments includes a display portion and a sliding portion extending from the display portion, and the display device further comprises:

a plurality of sliding mechanisms for sliding the sliding portions of the side segments under the upper surface of the frame, each of the sliding mechanisms including a pair of rails disposed on the bottom surface of the frame for receiving the sliding portions of the side segments.

10. The display device of claim 9, wherein the center segment includes left and right panels, and a center panel disposed between the left and right panels, and the display device further comprises:

an adjustment mechanism for reducing a size of the center segment and slidably moving the reduced center segment under the upper surface of the frame.

11. The display device of claim 10, wherein the adjustment mechanism includes:

a pair of rack gears disposed in parallel underneath the right and left panels of the center segment, and a pinion gear in gearing relationship with the rack gears and disposed underneath the center panel of the center segment.

12. The display device of claim 11, wherein the adjustment mechanism further includes:

a pair of rails disposed on the bottom surface of the frame for moving the center segment underneath the upper surface of the frame.

13. The display device of claim 12, wherein the adjustment mechanism further includes:

a pair of guiding members for assisting an adjustment process of the center segment.

14. The display device of claim 9, the upper and bottom surfaces of the frame and the sliding portions of the side segments are coated with a background color, and the display portions of the side segments are coated with a display color which differs from the background color.

15. The display device of claim 14, wherein the center segment is coated with the display color.

* * * * *